US010249945B2

(12) United States Patent
Peng et al.

(10) Patent No.: US 10,249,945 B2
(45) Date of Patent: Apr. 2, 2019

(54) ELECTRONIC DEVICE HAVING ANTENNA STRUCTURE

(71) Applicant: Wistron NeWeb Corp., Hsinchu (TW)

(72) Inventors: Huang-Tse Peng, Hsinchu (TW); Kuo-Jen Lai, Hsinchu (TW); Cheng-Feng Li, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 420 days.

(21) Appl. No.: 14/864,905

(22) Filed: Sep. 25, 2015

(65) Prior Publication Data

US 2016/0211571 A1 Jul. 21, 2016

(30) Foreign Application Priority Data

Jan. 20, 2015 (TW) ..... 104101775 A

(51) Int. Cl.

| | |
|---|---|
| ***H01Q 1/24*** | (2006.01) |
| ***H01Q 1/48*** | (2006.01) |
| ***H01Q 13/10*** | (2006.01) |
| ***H01Q 9/04*** | (2006.01) |

(52) U.S. Cl.

CPC ..... *H01Q 1/48* (2013.01); *H01Q 1/243* (2013.01); *H01Q 9/0421* (2013.01); *H01Q 13/10* (2013.01)

(58) Field of Classification Search

CPC ..... H01Q 1/243; H01Q 1/48; H01Q 13/10
See application file for complete search history.

(56) References Cited

U.S. PATENT DOCUMENTS

| | | | | |
|---|---|---|---|---|
| 8,577,289 | B2 * | 11/2013 | Schlub | G01B 7/023 343/702 |
| 9,203,141 | B1 * | 12/2015 | Su | H01Q 7/00 |
| 9,680,212 | B2 * | 6/2017 | Konu | H01Q 1/48 |
| 9,819,073 | B2 * | 11/2017 | Park | H01Q 1/243 |
| 9,882,284 | B2 * | 1/2018 | Eom | H01Q 1/243 |
| 2002/0022459 | A1 * | 2/2002 | Kobayashi | H01Q 1/243 455/575.7 |
| 2002/0183032 | A1 * | 12/2002 | Fang | G06F 1/1616 455/280 |
| 2006/0270472 | A1 * | 11/2006 | Chen | H01Q 1/243 455/575.7 |
| 2008/0182539 | A1 * | 7/2008 | Hata | H01Q 1/22 455/269 |

(Continued)

OTHER PUBLICATIONS

"Office Action of Taiwan Counterpart Application," dated Apr. 11, 2017, p. 1-p. 6.

*Primary Examiner* — Dameon E Levi
*Assistant Examiner* — Ab Salam Alkassim, Jr.
(74) *Attorney, Agent, or Firm* — JCIPRNET

(57) ABSTRACT

An electronic device has a front side and a rear side opposite to each other and includes a back cover and an antenna structure. The back cover is disposed at the rear side. The antenna structure includes a first radiation portion, a second radiation portion and a ground portion. The first radiation portion is disposed at the front side. The second radiation portion is disposed between the first radiation portion and the back cover and is connected to the first radiation portion. The ground portion is disposed between the first radiation portion and the back cover, wherein the second radiation portion is grounded to the back cover through the ground portion.

14 Claims, 3 Drawing Sheets

(56) References Cited

U.S. PATENT DOCUMENTS

2008/0316117 A1* 12/2008 Hill ..... H01Q 1/243 343/702
2010/0053002 A1* 3/2010 Wojack ..... H01Q 1/243 343/702
2010/0245177 A1* 9/2010 Jagielski ..... H01Q 1/243 343/702
2012/0100817 A1* 4/2012 Schachar ..... H01Q 1/243 455/73
2012/0176278 A1* 7/2012 Merz ..... H01Q 1/243 343/702
2012/0268328 A1* 10/2012 Kim ..... H01Q 1/243 343/702
2013/0194143 A1* 8/2013 Bungo ..... H01Q 21/28 343/725
2013/0307751 A1* 11/2013 Yu-Jiun ..... H01Q 1/243 343/893
2013/0342411 A1* 12/2013 Jung ..... H01Q 1/243 343/767
2014/0228080 A1* 8/2014 Choi ..... B29C 45/14639 455/575.1
2014/0253392 A1* 9/2014 Yarga ..... H01Q 5/328 343/702
2014/0266941 A1* 9/2014 Vazquez ..... H01Q 13/103 343/746
2014/0354486 A1* 12/2014 Flores-Cuadras ..... H01Q 1/38 343/700 MS
2014/0354491 A1* 12/2014 Kim ..... H01Q 1/243 343/702
2015/0009076 A1* 1/2015 Jang ..... H01Q 1/2266 343/702
2015/0077307 A1* 3/2015 Liou ..... H01Q 7/00 343/861
2015/0123856 A1* 5/2015 Qiu ..... H01Q 1/243 343/702
2015/0123857 A1* 5/2015 Park ..... H01Q 1/243 343/702
2015/0171508 A1* 6/2015 Jeon ..... H01Q 1/243 343/702
2016/0064820 A1* 3/2016 Kim ..... H01Q 1/243 343/767
2016/0088130 A1* 3/2016 Jung ..... G06F 1/1626 455/575.1
2016/0142083 A1* 5/2016 Kim ..... H04B 1/1009 455/300
2016/0197396 A1* 7/2016 Choi ..... H01Q 1/243 343/702
2016/0197403 A1* 7/2016 Choi ..... H01Q 1/243 343/700 MS
2016/0254588 A1* 9/2016 Kim ..... H01Q 1/24 343/702
2016/0329627 A1* 11/2016 Hong ..... H01Q 1/243
2017/0141452 A1* 5/2017 Hsieh ..... H01Q 1/22

* cited by examiner

ELECTRONIC DEVICE HAVING ANTENNA STRUCTURE

CROSS-REFERENCE TO RELATED APPLICATION

This application claims the priority benefit of Taiwan application serial no. 104101775, filed on Jan. 20, 2015. The entirety of the above-mentioned patent application is hereby incorporated by reference herein and made a part of this specification.

BACKGROUND OF THE INVENTION

[Field of the Invention]

The invention relates to an electronic device. More particularly, the invention relates to an electronic device having an antenna structure.

[Description of Related Art]

With the rapid development of wireless communication technology, a variety of mobile communication devices, such as smart phone, tablet PC and notebook computer, are continually being improved. Besides committing to enhancing operational functions of mobile communication devices, current manufacturers are raising the design requirements for appearance of mobile communication devices in order to attract the attention of consumers.

For example, current mobile communication devices mostly adopt an appearance design of metallic texture, such as a back cover or metal borders, to highlight the uniqueness and appearance design of the product. However, radiation characteristics of the antenna are easily affected by surrounding metal objects. For example, the back cover causes a shielding effect for the antenna and decreases the ability of the antenna to send and receive signals. Therefore, when a back cover is disposed due to design requirements for appearance in a mobile communication device, the communication quality of the mobile communication device is often affected as well. In other words, the appearance design of metallic texture infuses a sense of fashion for the mobile communication device, but also brings even larger challenge for the design of antenna in the mobile communication device.

SUMMARY OF THE INVENTION

The invention provides an electronic device, and an antenna structure thereof has a good ability of sending and receiving signals.

The electronic device of an embodiment of the invention has a front side and a rear side opposite to each other and includes a back cover and an antenna structure. The antenna structure includes a first radiation portion, a second radiation portion and a ground portion. The first radiation portion is disposed at the front side. The second radiation portion is disposed between the first radiation portion and the back cover and is connected to the first radiation portion. The ground portion is disposed between the first radiation portion and the back cover, wherein the second radiation portion is grounded to the back cover through the ground portion.

Accordingly, in the electronic device of the embodiment of the invention, the metal back cover is positioned at the rear side of the electronic device, and the first radiation portion of the antenna structure is positioned at the front side of the electronic device to be distant from the metal back cover. Thus, the ability of the antenna structure to send and receive signals is less likely to decrease due to shielding of the metal back cover. In addition, the second radiation portion of the antenna structure connects to the first radiation portion and extends to an internal portion of the electronic device, such that the antenna structure has sufficient size to achieve radiation characteristics as required. Furthermore, the second radiation portion of the antenna structure is grounded to the metal back cover through the ground portion, so as to decrease the influence of the metal back cover on the radiation characteristics of the antenna structure. Accordingly, in the situation that the metal back cover is disposed based on design requirements for appearance or other design requirements of the electronic device, the metal back cover does not affect normal operation of the antenna structure, so that the electronic device has both an appearance of metallic texture and a good ability of sending and receiving signals.

To make the above and other features and advantages of the invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate an exemplary embodiment of the invention and, together with the description, serve to explain the principles of the invention.

DESCRIPTION OF THE EMBODIMENTS

Figure 1:
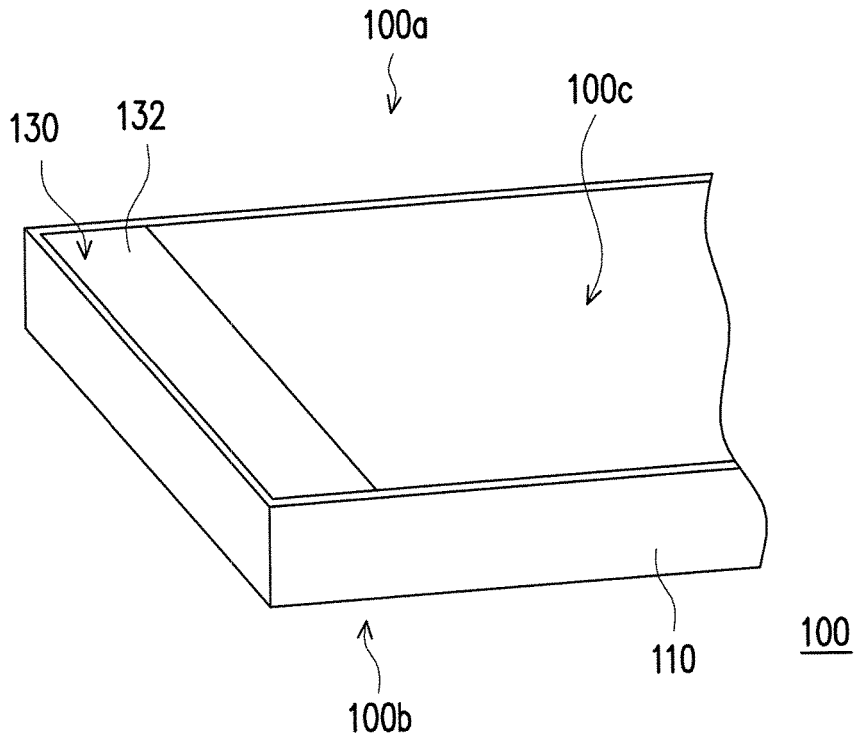
FIG. 1 is a partial perspective view of an electronic device according to an embodiment of the invention.
Figure 2:
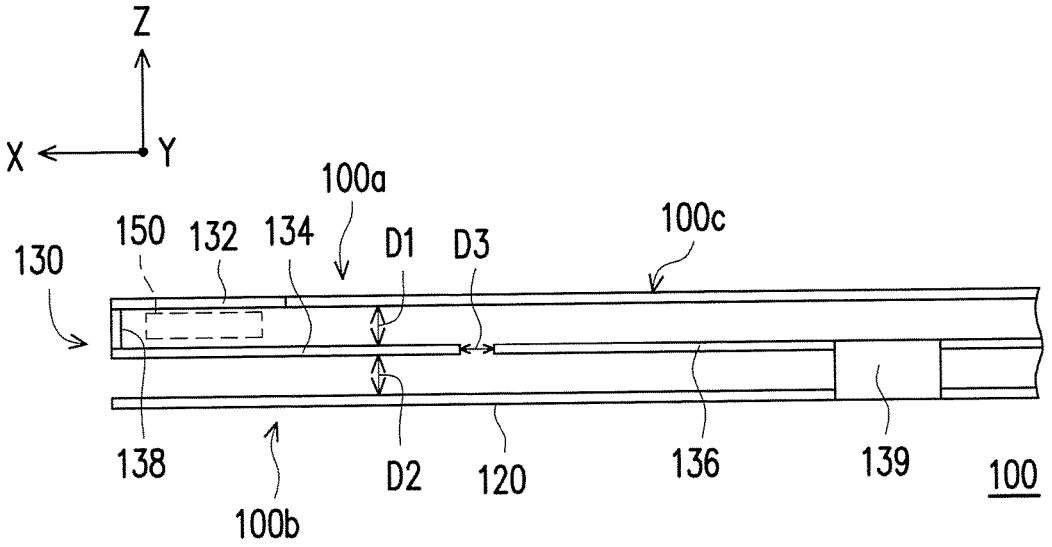
FIG. 2 is a perspective view illustrating a partial structure of the electronic device in FIG. 1.
Figure 3:
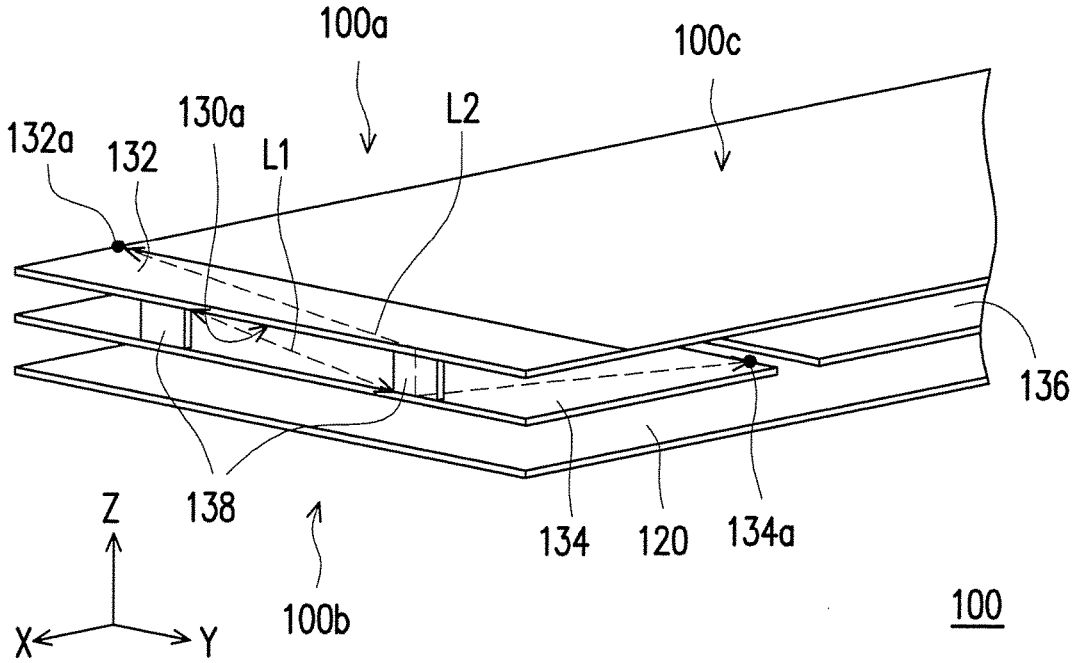
FIG. 3 is a side view of the electronic device in FIG. 2.

FIG. 1 is a partial perspective view of an electronic device according to one embodiment of the invention. FIG. 2 is a perspective view illustrating a partial structure of the electronic device in FIG. 1. FIG. 3 is a side view of the electronic device in FIG. 2. Referring to FIGS. 1-3, the electronic device 100 of the embodiment is, for example, a smart phone or other kinds of hand-held electronic devices. The electronic device 100 of the embodiment has a front side 100*a*, a rear side 100*b* and a display surface 100*c*. The front side 100*a* is opposite to the rear side 100*b*, and the display surface 100*c* is positioned at the front side 100*a*. The electronic device 100 includes an outer frame 110 and a back cover 120. The outer frame 110 is disposed at the peripheral edge of the electronic device 100. The back cover 120 is disposed at the rear side 100*b* of the electronic device 100, and the back cover 120 and the outer frame 110 shield internal components of the electronic device 100 together. A material of the back cover 120 is, for example, a metal.

The electronic device 100 further includes an antenna structure 130. The antenna structure 130 includes a first radiation portion 132, a second radiation portion 134 and a ground portion 136. The first radiation portion 132 is disposed at the front side 100*a* of the electronic device 100. The second radiation portion 134 is disposed between the first radiation portion 132 and the back cover 120 and is connected to the first radiation portion 132. The ground portion 136 is disposed between the first radiation portion 132 and the back cover 120, wherein the second radiation portion 134 is grounded to the back cover 120 through the ground portion 136. The second radiation portion 134 and the ground portion 136 of the embodiment are, for example, disposed at one same circuit board in the electronic device 100, or respectively disposed at different circuit boards in the electronic device 100, which should not be construed as a limitation to the invention.

When disposed in the above manner, since the metal back cover 120 is positioned at the rear side 100*b* of the electronic device 100, and the first radiation portion 132 of the antenna structure 130 is positioned at the front side 100*a* of the electronic device 100 to be distant from the metal back cover 120, the ability of the antenna structure 130 to send and receive signals is less likely to decrease due to shielding of the metal back cover 120. In addition, the second radiation portion 134 of the antenna structure 130 connects to the first radiation portion 132 and extends to an internal portion of the electronic device 100, such that the antenna structure 130 has sufficient size to achieve radiation characteristics as required. Furthermore, the second radiation portion 134 of the antenna structure 130 is grounded to the metal back cover 120 through the ground portion 136, so as to decrease the influence of the metal back cover 120 on the radiation characteristics of the antenna structure 130. Accordingly, the metal back cover 120 is disposed based on appearance design requirements or other design requirements of the electronic device 100, the metal back cover 120 does not affect normal operation of the antenna structure 130, so that the electronic device 100 has both an appearance of metallic texture and a good ability to sending and receiving signals.

Referring to FIG. 2 and FIG. 3, in the embodiment, the antenna structure 130 further includes two connecting portions 138. The connecting portions 138 connect between the first radiation portion 132 and the second radiation portion 134, wherein the first radiation portion 132, the second radiation portion 134 and the two connecting portions 138 have a slot 130*a* therebetween, wherein the slot 130*a* forms a slot antenna. A length (illustrated as a diagonal length L1 of the slot 130*a*) of the slot antenna equals to 0.5 times of a wavelength of a signal received by the slot antenna. In addition, the first radiation portion 132, the connecting portion 138 and the second radiation portion 134, for example, form an inverted-F antenna (IFA). A length (illustrated as a path length L2 passing through an end 132*a* of the first radiation portion 132, the connecting portion 138, and a feed point 134*a* of the second radiation portion 134) of the inverted-F antenna equals to 0.25 times of a wavelength of a signal received by the inverted-F antenna.

Figure 4:
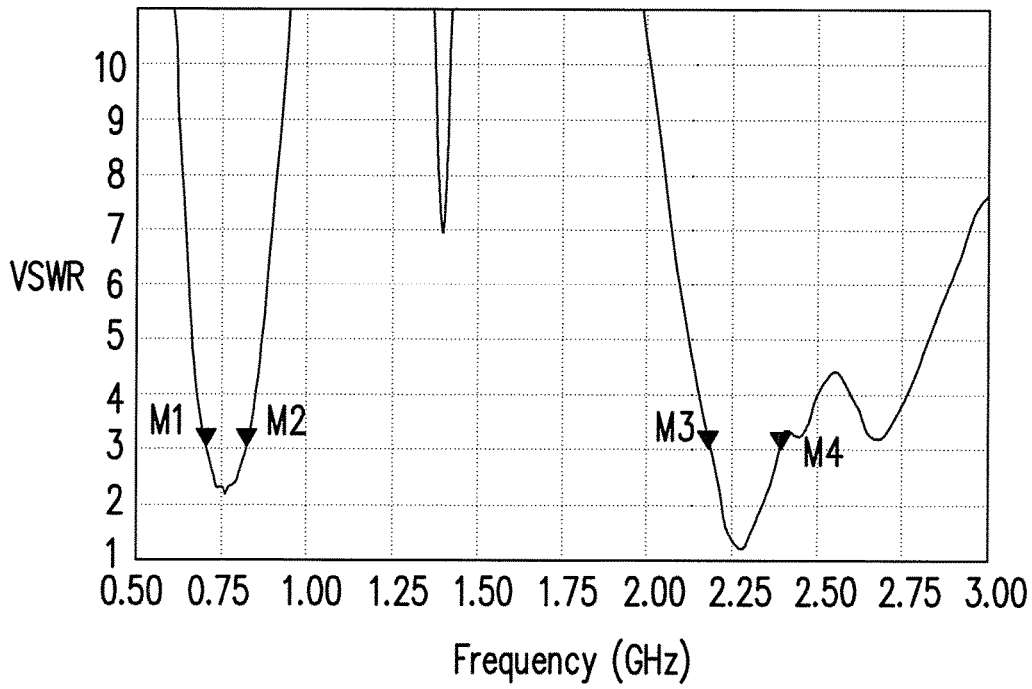
FIG. 4 illustrates a voltage standing wave ratio (VSWR) of the antenna structure in FIG. 3.

FIG. 4 illustrates a voltage standing wave ratio (VSWR) of the antenna structure in FIG. 3, wherein the y-axis is voltage standing wave ratio, and the x-axis is frequency. Referring to FIG. 4, M1 and M2 indicate a frequency band corresponding to a low-frequency mode of the inverted-F antenna, and M3 and M4 indicate a frequency band corresponding to a high-frequency mode of the slot antenna. Voltage standing wave ratios of the low-frequency mode and the high-frequency mode are all less than 3 and compliant with the standards of antenna of hand-held electronic devices.

Referring to FIGS. 2 and 3, more specifically, the first radiation portion 132, the second radiation portion 134 and the back cover 120 are sequentially arranged at intervals from the front side 100*a* to the rear side 100*b* of the electronic device 100. The second radiation portion 134 and the ground portion 136 are coplanar with each other. An extending direction (X-axis) of the first radiation portion 132, the second radiation portion 134 and the ground portion 136 is parallel to an extending direction (X-axis) of the back cover 120. An extending direction (Z-axis) of each of the connecting portions 138 is perpendicular to an extending direction (X-axis) of the first radiation portion 132 and the second radiation portion 134. The antenna structure 130 as illustrated in FIG. 2 further includes a connecting portion 139 connected between the ground portion 136 and the back cover 120, such that the second radiation portion 134 is grounded to the back cover 120 through the ground portion 136, wherein an extending direction (Z-axis) of the connecting portion 139 is perpendicular to an extending direction (X-axis) of the ground portion 136 and the back cover 120.

In the embodiment, a distance D1 between the first radiation portion 132 and the second radiation portion 134 is, for example, 4 mm, and a distance D2 between the second radiation portion 134 and the back cover 120 is, for example, 3 mm, so as to prevent the metal back cover 120 from being too close in distance to the antenna structure 130 to affect normal operation of the antenna structure 130. Furthermore, a distance D3 between the second radiation portion 134 and the ground portion 136 is, for example, 1.5 mm, so that the antenna structure 130 has preferable impedance matching. In other embodiments, the distance D1, the distance D2 and the distance D3 can also be other suitable values, which should not be construed as a limitation to the invention.

Figure 5:
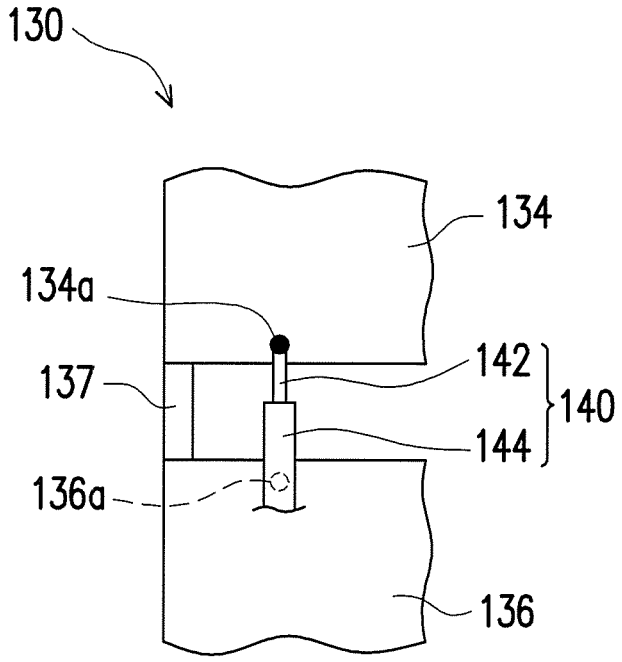
FIG. 5 is a partial top view of the antenna structure in FIG. 3.

FIG. 5 is a partial top view of the antenna structure in FIG. 3. Referring to FIG. 5, the second radiation portion 134 and the ground portion 136 of the embodiment have a gap therebetween, and the antenna structure 130 further includes a short-circuit portion 137 connected between the second radiation portion 134 and the ground portion 136. Furthermore, the electronic device 100 (illustrated in FIG. 3) includes a cable 140 having a signal line 142 and a ground line 144 coaxial with each other. The signal line 142 is connected to the feed point 134*a* of the second radiation portion 134, and the ground line 144 is connected to a ground point 136*a* of the ground portion 136. For purposes of clarity of figures, the short-circuit portion 137 and the cable 140 in FIG. 5 are not illustrated in FIGS. 2 and 3.

In the embodiment, the first radiation portion 132 and the back cover 120 are both appearance parts of the electronic device 100. For example, the electronic device 100 as illustrated in FIG. 2 includes a speaker 150, and the first radiation portion 132 is a cover body used to cover the speaker 150. In other embodiments, the first radiation portion 132 can be other appearance part or non-appearance part of the front side 100*a* of the electronic device 100, which should not be construed as a limitation to the invention.

In summary of the above, in the electronic device of the invention, the metal back cover is positioned at the rear side of the electronic device, and the first radiation portion of the antenna structure is positioned at the front side of the electronic device to be distant from the metal back cover. Thus, the ability of the antenna structure to send and receive signals is less likely to decrease due to shielding of the metal back cover. In addition, the second radiation portion of the antenna structure connects to the first radiation portion and extends to an internal portion of the electronic device, such that the antenna structure has sufficient size to achieve radiation characteristics as required. Furthermore, the second radiation portion of the antenna structure is grounded to the metal back cover through the ground portion, so as to decrease the influence of the metal back cover on the radiation characteristics of the antenna structure. Accordingly, in the situation that the metal back cover is disposed based on design requirements for appearance or other design requirements of the electronic device, the metal back cover does not affect normal operation of the antenna structure, so that the electronic device has both an appearance of metallic texture and a good ability of sending and receiving signals.

Although the invention has been described with reference to the above embodiment, it will be apparent to those skilled in the art that various modifications and variations can be made to the disclosed embodiment without departing from the scope or spirit of the invention. In view of the foregoing, it is intended that the invention covers modifications and variations provided that they fall within the scope of the following claims and their equivalents.

What is claimed is:

1. An electronic device, having a front side and a rear side opposite to each other and comprising:

a display surface positioned at the front side;

a back cover disposed at the rear side; and an antenna structure, comprising:

a first radiation portion disposed at the front side;

a second radiation portion disposed between the first radiation portion and the back cover and connected to the first radiation portion;

a ground portion disposed between the first radiation portion and the back cover, wherein the second radiation portion is grounded to the back cover through the ground portion; and at least one connecting portion connected between the first radiation portion and the second radiation portion, wherein the first radiation portion, the at least one connecting portion and the second radiation portion form an inverted-F antenna, wherein the first radiation portion and the back cover are exterior parts of the electronic device, wherein the first radiation portion, the second radiation portion and the back cover are sequentially arranged at intervals.

2. The electronic device according to claim 1, wherein a quantity of the at least one connecting portion is two, and the first radiation portion, the second radiation portion and the two connecting portions have a slot therebetween, and the slot forms a slot antenna.

3. The electronic device according to claim 2, wherein the slot antenna receives a signal, and a length of the slot antenna is 0.5 times of a wavelength of the signal.

4. The electronic device according to claim 1, wherein the inverted-F antenna receives a signal, and a length of the inverted-F antenna is 0.25 times of a wavelength of the signal.

5. The electronic device according to claim 1, wherein an extending direction of the connecting portion is perpendicular to an extending direction of the first radiation portion and the second radiation portion.

6. The electronic device according to claim 1, wherein an extending direction of the first radiation portion, the second radiation portion and the ground portion is parallel to an extending direction of the back cover.

7. The electronic device according to claim 1, wherein the second radiation portion and the ground portion are coplanar with each other.

8. The electronic device according to claim 1, wherein the second radiation portion and the ground portion have a gap therebetween.

9. The electronic device according to claim 1, wherein the antenna structure comprises a short-circuit portion connected between the second radiation portion and the ground portion.

10. The electronic device according to claim 1, comprising a cable, wherein the cable comprises a signal line connected to the second radiation portion and a ground line connected to the ground portion.

11. The electronic device according to claim 1, wherein the antenna structure comprises a connecting portion connected between the ground portion and the back cover.

12. The electronic device according to claim 11, wherein an extending direction of the connecting portion is perpendicular to an extending direction of the ground portion and the back cover.

13. The electronic device according to claim 1, comprising a speaker, wherein the first radiation portion covers the speaker.

14. The electronic device according to claim 1, wherein a material of the back cover comprises a metal.

* * * * *